US008579300B2

(12) United States Patent
Fraley

(10) Patent No.: US 8,579,300 B2
(45) Date of Patent: Nov. 12, 2013

(54) SPRING-BASED SKATEBOARD TRUCK WITH SWINGABLE KINGPIN

(75) Inventor: James J. Fraley, Encinitas, CA (US)

(73) Assignee: Pluto Technologies Inc., Carlsbad, CA (US)

( * ) Notice: Subject to any disclaimer, the term of this patent is extended or adjusted under 35 U.S.C. 154(b) by 315 days.

(21) Appl. No.: 12/639,846

(22) Filed: Dec. 16, 2009

(65) Prior Publication Data

US 2011/0140385 A1 Jun. 16, 2011

(51) Int. Cl.
*A63C 17/01* (2006.01)

(52) U.S. Cl.
USPC ..... 280/11.28; 280/87.042

(58) Field of Classification Search
USPC ..... 280/11.27, 11.28, 87.041, 87.042, 280/47.22, 79; 267/169, 185, 215, 255, 291
See application file for complete search history.

(56) References Cited

U.S. PATENT DOCUMENTS

| | | | | | |
|---|---|---|---|---|---|
| 1,603,529 | A * | 10/1926 | Faust | 280/11.19 |
| 2,032,657 | A * | 3/1936 | Frederickson | 280/124.111 |
| 2,572,133 | A * | 10/1951 | Glenn | 280/11.28 |
| 4,054,297 | A * | 10/1977 | Solimine | 280/87.042 |
| 4,089,536 | A * | 5/1978 | Larrucea | 280/11.28 |
| 4,120,508 | A * | 10/1978 | Brown et al. | 280/11.28 |
| 6,224,076 | B1 * | 5/2001 | Kent | 280/87.042 |
| 6,286,843 | B1 * | 9/2001 | Lin | 280/11.28 |
| 6,474,666 | B1 * | 11/2002 | Andersen et al. | 280/87.041 |
| 6,547,262 | B1 | 4/2003 | Yamada et al. | 280/11.28 |
| 6,616,155 | B2 * | 9/2003 | Tuan | 280/87.041 |
| 6,863,283 | B1 * | 3/2005 | Houston et al. | 280/11.225 |
| 7,093,842 | B2 * | 8/2006 | Chmelar | 280/87.042 |
| 7,104,558 | B1 | 9/2006 | Saldana | 280/87.042 |
| 7,581,739 | B2 * | 9/2009 | Fraley | 280/87.041 |
| 8,251,383 | B2 * | 8/2012 | Dickie | 280/87.042 |
| 2009/0160143 | A1 | 6/2009 | Fraley | 280/11.28 |
| 2011/0089659 | A1 * | 4/2011 | Hunt | 280/124.121 |
| 2011/0210526 | A1 * | 9/2011 | Williams, Jr. | 280/11.28 |

* cited by examiner

*Primary Examiner* — Katy M Ebner
*Assistant Examiner* — Emma K Frick
(74) *Attorney, Agent, or Firm* — DLA Piper LLP (US)

(57) ABSTRACT

A truck assembly comprises a baseplate including a pivot arm hole, a first kingpin hole and a spring holder. A wheel axle is couplable to a wheel on each end of the wheel axle. A pivot arm is inserted into the pivot arm hole of the baseplate. An axle housing has a first end, a second end and a second kingpin hole. The first end includes the wheel axle and the second kingpin hole, and the second end includes the pivot arm. A swingable kingpin includes a first portion and a second portion. The first portion swings relative to the second portion. A spring member is provided substantially parallel to the kingpin and is coupled to the spring holder of the baseplate and the first end of the axle housing.

20 Claims, 11 Drawing Sheets

SPRING-BASED SKATEBOARD TRUCK WITH SWINGABLE KINGPIN

BACKGROUND OF THE INVENTION

Conventional skateboard decks are manufactured out of plywood laminates using woods such as Canadian maple. Trucks are mounted on the front and rear ends of the bottom surface of the deck. Each truck includes a baseplate that is bolted directly to the deck, and an axle housing attached to the baseplate by a kingpin. The kingpin holds together the baseplate and axle housing. Wheels are attached to the respective ends of the axle housing. Decks are typically solid throughout, except for the truck mounting chambers. Rubber grommets are provided between the axle housing and baseplate, as well as below the axle housing, for shock absorption.

This conventional construction presents several problems. As discussed in U.S. Pat. No. 7,581,739, which is incorporated herein by reference, the rubber grommets of conventional trucks steadily deteriorate with use such that the shock absorption and performance of the trucks degrades quickly and is inconsistent over time. FIG. 5 illustrates a conventional rubber grommet truck suspension system 50 including rubber grommets 53 and 54 that dampen shocks and vibrations. Metal sleeves 55 and 56 cover respective grommets 53 and 54. Rubber grommet (bushing) 53 is provided between axle housing 51 and baseplate 52, and rubber grommet (cone bushing) 54 is provided between axle housing 51 and nut 57 of kingpin 58. Conventional kingpins are merely single piece bolts having a nut on one or both ends for adjusting tension. The kingpin is fixed in position. Rubber grommets act only to dampen shocks and minimize feedback into the skateboard deck. Conventional grommets act as dampers to dissipate shocks and vibrations from a user. The energy used to compress a grommet is largely dissipated. The grommets can also be worn down by friction and pressure, and thus may have difficulty in providing a durable and consistent user experience. The mechanical strain properties of rubber presents numerous deficiencies in skateboard performance. The response of rubber grommets differs between low and high strain rates (slow and fast forces). For example, in a low strain rate application where a user leans to one side on a skateboard, a gradual and steady force is applied to turn the trucks. In this case, the rubber gives and provides a smooth response, even if the rubber itself steadily deteriorates over time. However, in a high strain rate situation, where the truck goes airborne and the trucks impact the ground with high force, the fast response of rubber is to provide a hard impact that does not dissipate the force smoothly or gradually at all. In other words, rubber shows little elasticity with quick and forceful impacts. Therefore, the response, or mechanical strain, of rubber will vary depending on the speed and strength of the force. Also, a user may tend to favor one side of the board over the other, thereby creating uneven wear on the grommets, leading to inconsistent performance over time. Metal spring coils do not suffer from this difference in performance between low and high strain forces. In low and high strain rates, spring coils provide elasticity in absorbing and redirecting force in a consistent and smooth manner.

Another drawback of conventional designs is that in order to adjust nut 57 of kingpin 58, a user must hold the bolt head at one end and screw nut 57 at the other end. Therefore, adjusting truck 50 is a tedious process that is difficult to do in the field. When nut 57 is tightened at axle 51, kingpin 58 protrudes outward from axle 51, interferes with grinding and increases the overall height of the truck. The projection of kingpin 58 and nut 57 from axle housing 51 increases the overall height of the truck assembly.

U.S. Pat. No. 6,547,262 improves turn performance by shaping upper grommet 20 into a pulley-shape, but utilizes traditional urethane grommets and single-piece kingpins. Over time, one in the art would expect upper grommet 20 to wear unevenly and reduce pivoting performance. U.S. Pat. No. 7,104,558 is directed to a skateboard truck having a single-piece steel kingpin 40 rigidly fixed to a base 50, and including a head 41, shaft 45 with shoulder 42 and a threaded portion 44, as is typical.

In some conventional trucks, springs are incorporated as resistance members to control the wheel tilt and turning radius of the skateboard. The springs are mounted at a slight angle from the plane of the deck in order to control the degree of turning relative to a lateral force applied to the deck. For example, when a user's weight is shifted to the right or left side of the deck, the wheel axle of the truck will tilt relative to the deck, thereby changing the rolling direction of the wheels. Separate springs are typically provided on each side of the wheel axle. Different spring tensions will alter the turning radius of the skateboard by resisting lateral force. However, the use of springs in this manner increases the weight, cost and size of the trucks.

SUMMARY OF THE INVENTION

In one embodiment of the invention, a truck assembly comprises a baseplate including a pivot arm hole, a first kingpin hole and a spring holder. A wheel axle is couplable to a wheel on each end of the wheel axle. A pivot arm is inserted into the pivot arm hole of the baseplate. An axle housing has a first end, a second end and a second kingpin hole. The first end includes the wheel axle and the second kingpin hole, and the second end includes the pivot arm. A swingable kingpin includes a first portion and a second portion. The first portion swings relative to the second portion. A spring member is provided substantially parallel to the kingpin and is coupled to the spring holder of the baseplate and the first end of the axle housing.

The swingable kingpin includes a swing bolt. The first portion is a baseplate end and the second portion is an axle end. The baseplate end is coupled to the first kingpin hole of the baseplate. The axle end is coupled to the second kingpin hole of the axle housing. The swing bolt is coupled to the baseplate end and the axle end. The baseplate end is concave and the axle end is a convex. The swing bolt is perpendicular to the wheel axle. The axle end is at least the height of the baseplate end. The kingpin swings along a predetermined range to prevent wheel bit. The axle end of the swingable kingpin locks into the second kingpin hole of the axle housing only through a first side of the axle housing. A tension of the kingpin is adjusted by adjusting a nut on the swing bolt. The spring member limits the swing of the swingable kingpin.

In another embodiment, a skateboard includes a deck and a truck assembly. The truck assembly includes a baseplate including a pivot arm hole, a first kingpin hole and a spring holder. A wheel axle is couplable to a wheel on each end of the wheel axle. A pivot arm is inserted into the pivot arm hole of the baseplate. An axle housing has a first end, a second end and a second kingpin hole. The first end includes the wheel axle and the second kingpin hole, and the second end includes the pivot arm. A swingable kingpin includes a first portion and a second portion. The first portion swings relative to the second portion. A spring member is provided substantially parallel to the kingpin and is coupled to the spring holder of the baseplate and the first end of the axle housing.

The swingable kingpin includes a swing bolt. The first portion is a baseplate end and the second portion is an axle end. The baseplate end is coupled to the first kingpin hole of the baseplate. The axle end is coupled to the second kingpin hole of the axle housing. The swing bolt is coupled to the baseplate end and the axle end. The swing bolt is perpendicular to the wheel axle. The baseplate end is at least the height of the axle end. The baseplate end is concave and the axle end is convex. The kingpin swings along a predetermined range to prevent wheel bite.

In another embodiment, a truck assembly comprises a baseplate including a pivot arm hole, a first kingpin hole and a spring holder. A wheel axle is couplable to a wheel on each end of the wheel axle. A pivot arm is inserted into the pivot arm hole of the baseplate. An axle housing has a first end, a second end and a second kingpin hole. The first end includes the wheel axle and the second kingpin hole, and the second end including the pivot arm. A kingpin is coupled to the first kingpin hole of the baseplate and to the second kingpin hole of the axle housing. A flexible member is provided along the circumference of the second kingpin hole. A spring member is provided substantially parallel to the kingpin and coupled to the spring holder of the baseplate and the first end of the axle housing. The flexible member is selected from the group consisting of a wire mesh, another spring member, and a plurality of cables. A nut is provided at the axle housing to adjust a tension of the spring member. The flexible member is in contact with the nut on the axle housing. The flexible member allows the kingpin and the nut to move freely within a predetermined range within the second kingpin hole.

DETAILED DESCRIPTION OF THE INVENTION

Figure 1A:
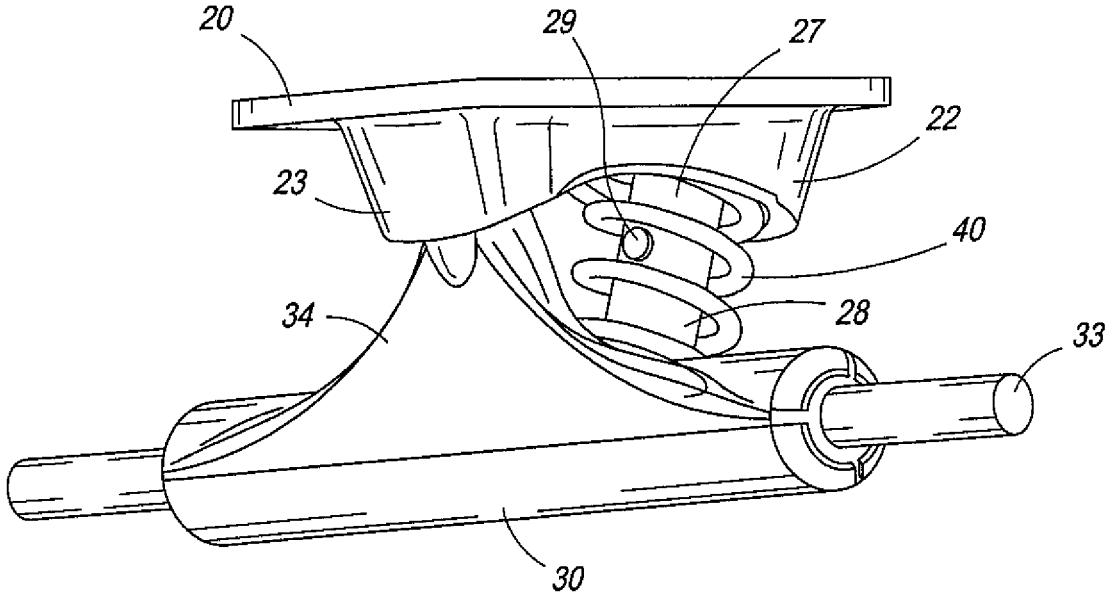
FIG. 1A is a first perspective view of the truck assembly according to one embodiment of the invention.
Figure 1B:
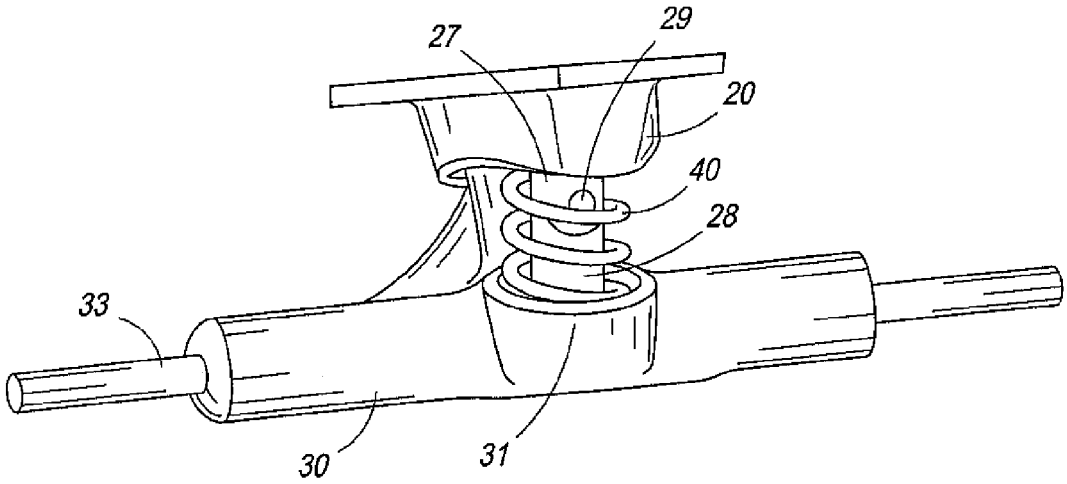
FIG. 1B is a second perspective view of the truck assembly according to one embodiment of the invention.

FIGS. 1A and 1B are perspective views of an entire truck assembly, including a baseplate 20 and an axle housing 30 coupled together by kingpin 43, formed components 27-29, discussed below. When used, for example, in a skateboard deck, baseplate 20 connects axle housing 30 to the deck. A first end of axle housing 30 holds a wheel axle 33 coupled to a wheel (not shown) attached to each end. The second end of axle housing 30 includes a pivot arm 34 that is inserted into corresponding pivot arm hole 23 of baseplate 20. Pivot arm hole 23 holds pivot arm 34 of axle housing 30 and allows pivot arm 34 to pivot within pivot arm hole 23. For example, if baseplate 20 or axle housing 30 is biased towards one side through applied force, pivot arm 34 will shift accordingly within pivot arm hole 23. When the truck assembly is used in a skateboard, the truck assembly will pivot to turn the wheels and also tilts the skateboard deck to allow a user to move in a desired direction. The geometry of pivot arm hole 23 is not limited in order to allow the ease or difficulty of pivoting to be adjusted based on desired characteristics.

Also provided on the first end of axle housing 30 is one end of a spring 40 and the axle end 28 of kingpin 43. The other end of spring 40 and the baseplate end 27 of kingpin 43 is connected to baseplate 20. Baseplate end 27 includes a threaded portion for a nut to screw into for the adjustment of spring tension. Baseplate end 27 can be a sex bolt and screwed into a corresponding sex nut. In particular, first kingpin hole 25 holds the bolt end (baseplate end) of kingpin 43 and spring holder 22 is a cavity for spring 40 to fit into. Kingpin 43 is provided within and substantially parallel to the coils of spring 40. A second kingpin hole 31 is provided at the wheel axle end of axle housing 30 for axle end 28 of kingpin 43. Baseplate end 27 is concave while the axle end is convex.

Figure 1C:
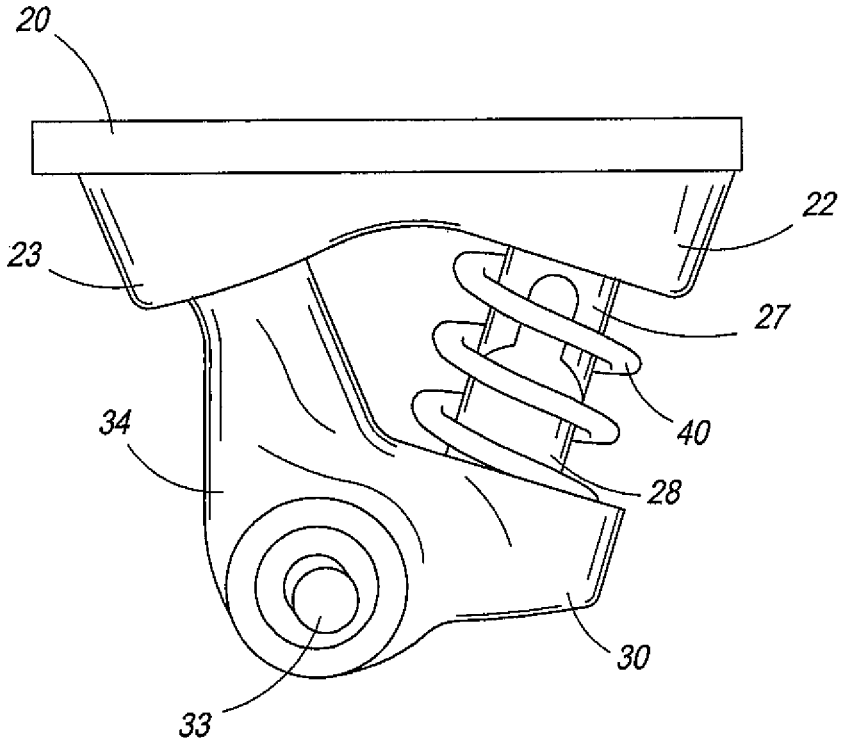
FIG. 1C is a side view of the truck assembly according to one embodiment of the invention.

In FIGS. 1A-1C, kingpin 43 does not protrude through axle housing 30 from one side through the other. Instead, axle end 28 is shaped to fit into a corresponding second kingpin hole in axle housing 30, thereby obviating the need for a nut to protrude from the bottom of axle housing 30 to tighten kingpin 43. In this manner, the bottom of axle housing 30 can be made smooth to improve grinding and also does not need to be formed as tall as a conventional axle housing such that the height of the truck is reduced. In other words, the axle end of the kingpin locks into the kingpin hole of axle 30 only through one side of the housing so as to not protrude through the entire axle. The baseplate end is at least as tall as the axle end. Consequently, the truck can be formed at a height of ¾ inches and above. Street skaters and bowl skaters prefer shorter trucks around 1½ inches while longboarders prefer higher trucks of around 2½ to 3 inches.

Figure 1D:
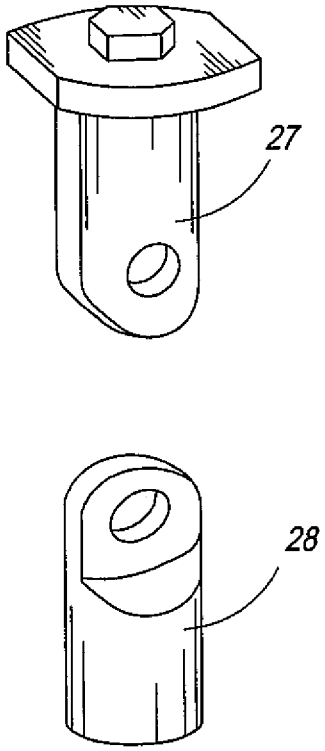
FIG. 1D is a disassembled view of the kingpin of the truck assembly according to one embodiment of the invention.

Swing bolt 29 connects baseplate end 27 and axle end 28 to each other such that kingpin 43 can swing. The range from which kingpin 43 can swing is limited by coil 40. The ease at which the kingpin swings depends on the tension of swing bolt 29 and corresponding nut. FIG. 1B is another perspective view of the truck assembly. Kingpin 43 swings about an axis of swing bolt 29. FIG. 1C is a side view of the truck assembly and shows kingpin 43 substantially parallel to coil 40. Swing bolt 29 is provided at the midpoint or closer to axle housing 30 and wheels than to baseplate 20 to provide better pivoting performance. As shown in FIG. 1D, baseplate end 27 includes a nut at one end to adjust the spring coil tension and truck characteristics, while axle end 28 is shaped to snap and lock into a corresponding shape in axle housing 30 without the need for a nut. This feature allows the kingpin to be reduced in size, thereby reducing the overall height of the truck. For example, the truck height can be reduced to ¾ of an inch instead of the standard 1½ inch. Therefore, trucks can be formed lighter and smaller, with less material, thereby reducing manufacturing costs. Alternatively, the lack of a nut protruding from the bottom of axle housing 30 allows coil 40 to be extended further to adjust performance characteristics.

The use of spring 40 instead of rubber grommets provides consistent performance in both fast and slow responses. In jumps and high speed impacts, the spring will absorb or redirect force as tuned, and in slow impacts such as turns, the spring will respond smoothly and predictably as well. The spring is forgiving in both jumps and turns, while the rubber is forgiving only for turns. The spring is also self-correcting and will naturally revert back its default horizontal position when twisted for turning. Rubber, by contrast, will degrade unevenly with use over time. The consistency of the truck's performance increases a users confidence and reduces injury due to equipment failure and miscalculation of the capabilities of the truck.

In one embodiment, a hole or crevice is formed in baseplate end 27 along with a swing bolt hole perpendicular to the hole and wheel axle. Axle end 28 forms a projection to fit the hole of baseplate end 27, the projection including a corresponding hole for swing bolt 29. A truck assembly utilizing bolt 29 and swinging kingpin 43 improves pivoting performance and shock absorption. When utilized in a skateboard deck, a sharper turning radius is provided and the swingable kingpin provides a greater freedom of movement. Tighter and quicker turns provide a rider more control. Furthermore, since a nut is not necessary at the axle end of the kingpin 43, the overall height of the truck can be advantageously reduced to provide a low truck.

Wheel bite is a term used to describe a wheel that contacts the deck due to excessive tilt of the truck and deck. Although the present invention makes turns easier through the swingable kingpin, the truck assembly also greatly reduces wheel bite because kingpin 43 is limited in swinging by the presence of spring 40 and the kingpin is also optimized in shape and height to prevent swinging beyond a predetermined range.

Figure 2A:
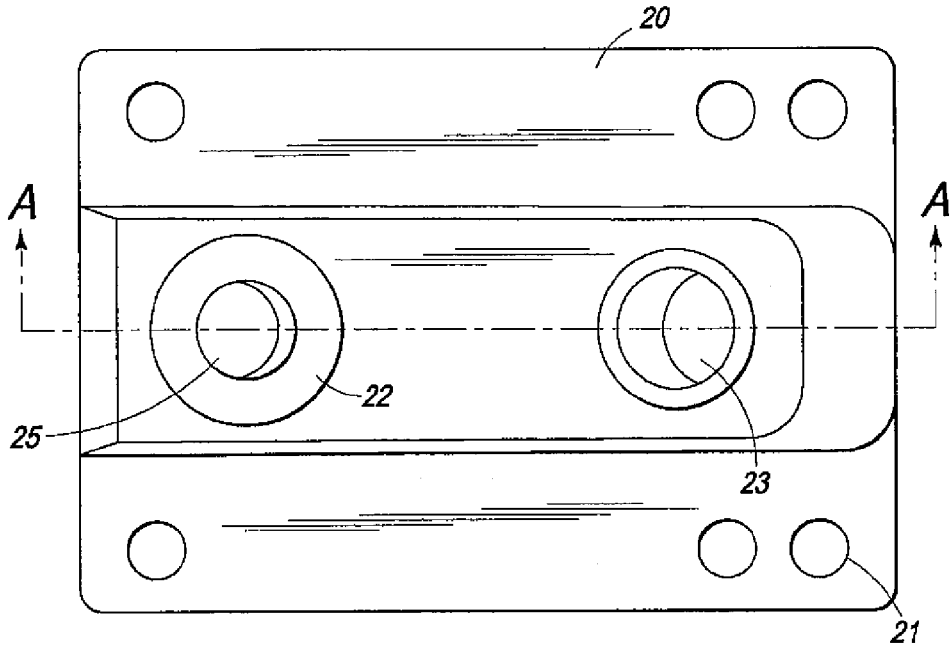
FIG. 2A is a bottom perspective view of the baseplate of a truck according to one embodiment of the invention.
Figure 2B:
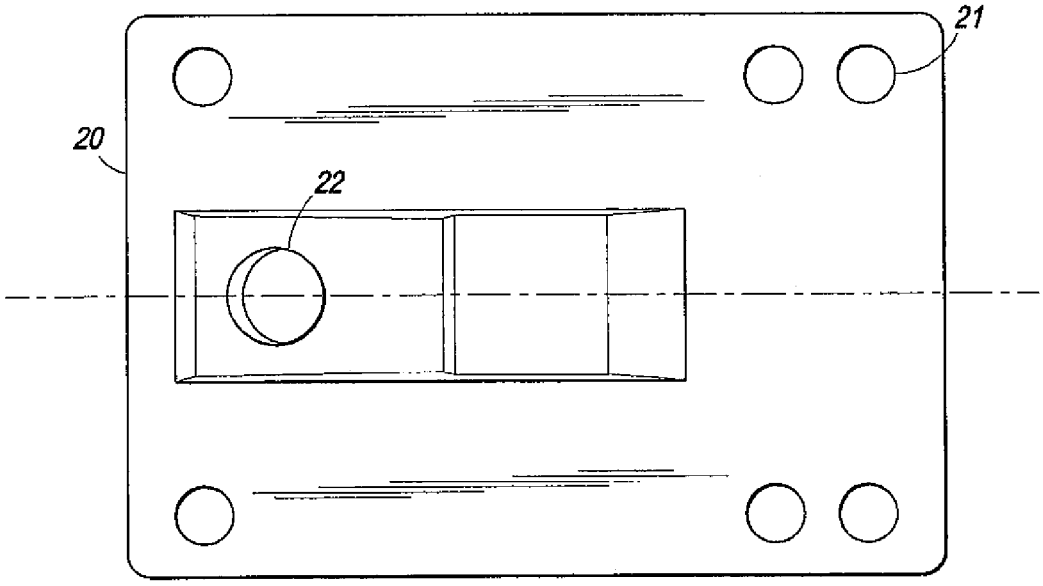
FIG. 2B is a top perspective view of the baseplate shown in FIG. 2A.
Figure 2C:
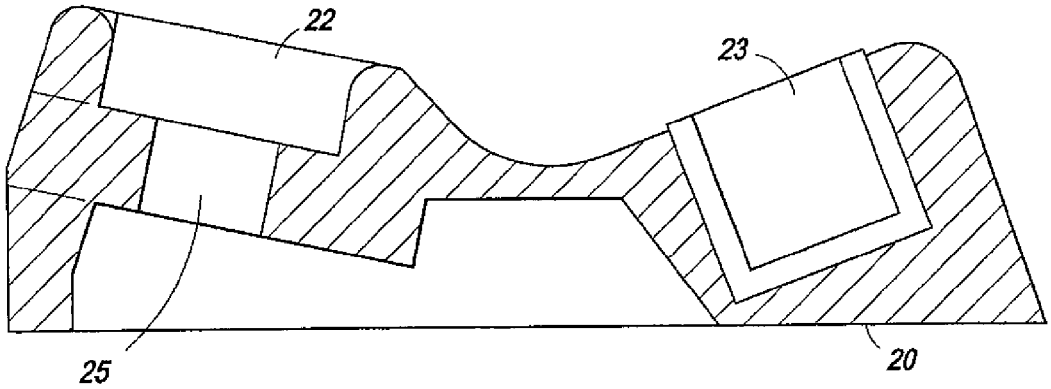
FIG. 2C is a cross-sectional view of the baseplate taken along the A-A line of FIG. 2A.

In FIGS. 2A-C, the bottom, top and cross-section of baseplate 20 is shown. A plurality of mounting holes 21 are provided to attach baseplate 20 to a deck using screws. The location, number and size of mounting holes 21 are standardized for trucks, but can be modified as necessary.

Figure 3A:
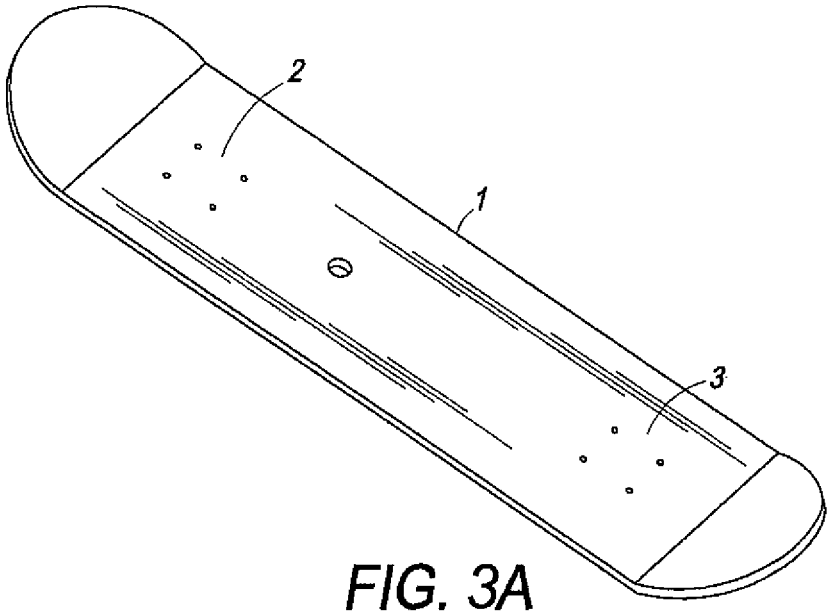
FIG. 3A is a top perspective view of the skateboard deck according to one embodiment of the invention.

FIG. 3A is a top view of the skateboard deck of another embodiment of the present invention. FIG. 3C is a side view of a skateboard having a deck 1 attached to the trucks described in FIGS. 1 and 2 and wheels 6. Deck 1 is formed of a variety of materials, such as wood or synthetics. The length, width and thickness of the deck conform to standard skateboard dimensions, but can be modified according to desired characteristics. Truck mounting portions 2 and 3 are provided at a front and rear end of the deck. The deck is made of, for example at least one layer of synthetic materials, such as fiberglass, resins, plastics, composite and Kevlar. These synthetic layers provide high impact resistance and are thus more durable and provide consistent performance over time. Decks constructed with three synthetic layers as shown show little deviation in structure or performance from one deck to the next.

Figure 3B:
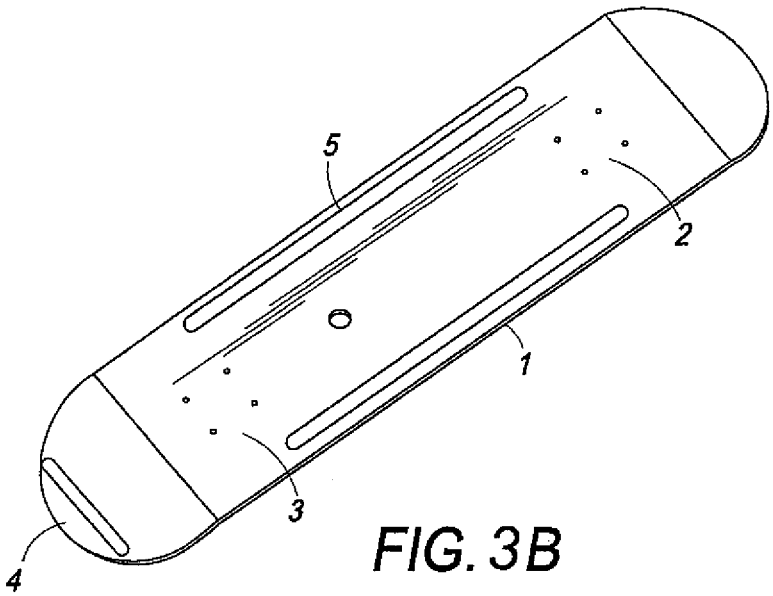
FIG. 3B is a bottom perspective view of the skateboard deck shown in FIG. 1A.
Figure 3C:
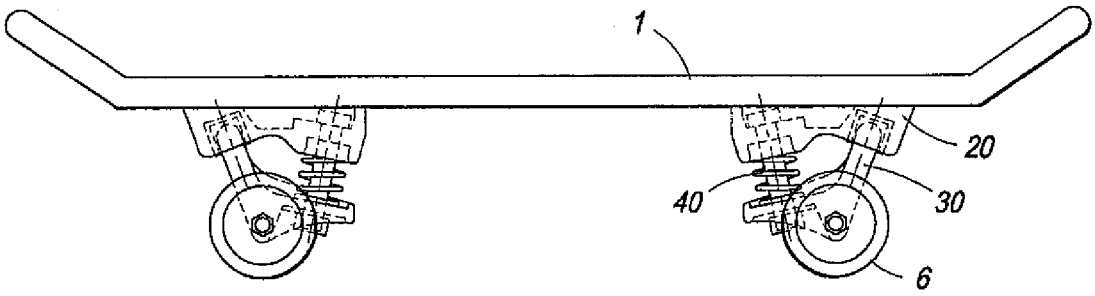
FIG. 3C is a side perspective view of an assembled skateboard according to one embodiment of the invention.

As shown in FIG. 3B, the bottom layer of deck 1 includes a skid plate 4 along the rear end of the deck that is a brake member or a grip member. Runner boards 5 are provided running lengthwise along the edges of the deck, from front truck mounting portion 2 to rear truck mounting portion 3 and are easily attached and removed from the deck using screws. The skid plates and the runner boards add protection and functionality to the deck. The skid plates and runner boards improve the ride and structural integrity of the deck. The trucks are mounted onto front truck mounting portion 2 and rear truck mounting portion 3 (FIGS. 3A-3B).

Figure 4A:
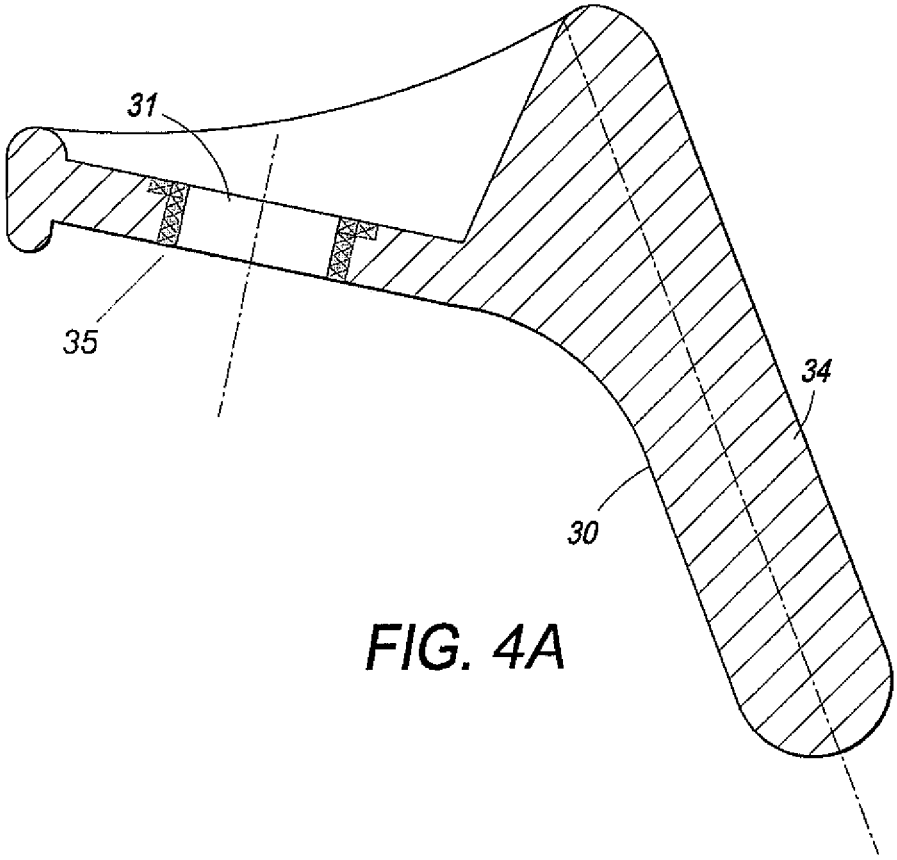
FIG. 4A is a cross-sectional view of the axle housing according to another embodiment of the invention.
Figure 4B:
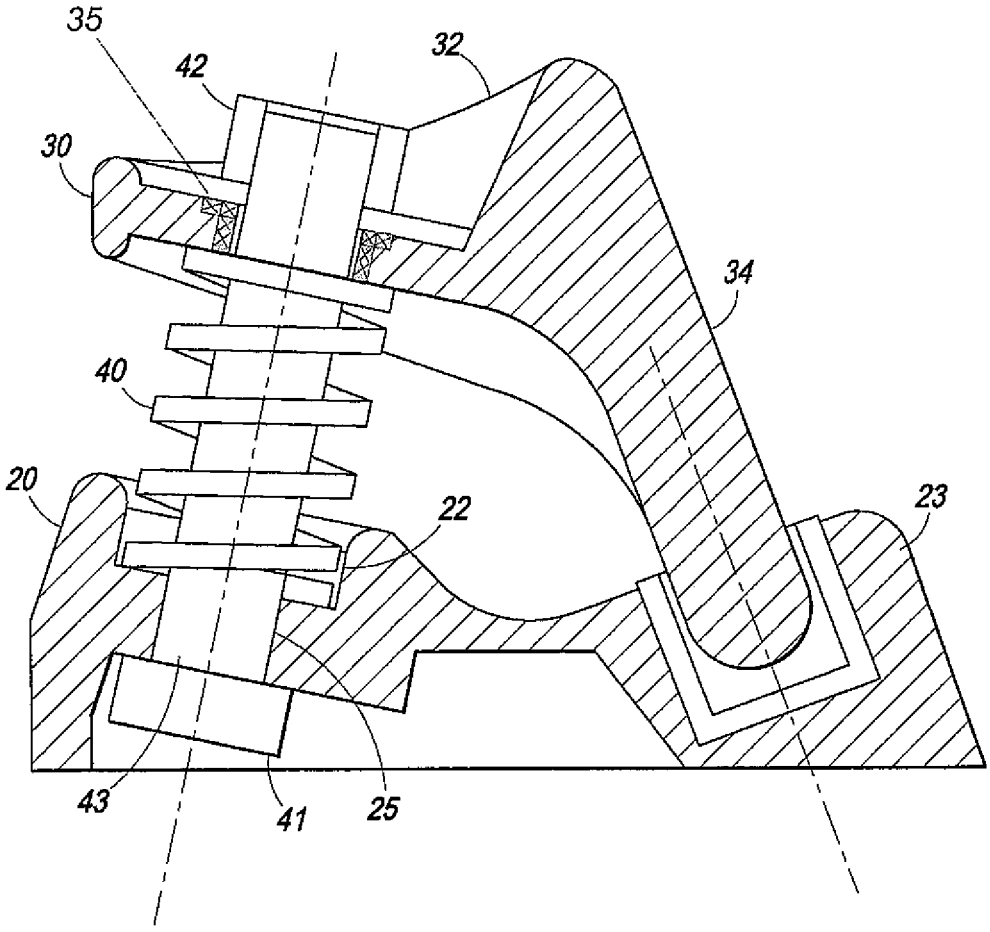
FIG. 4B is a cross-sectional view of the truck assembly according to another embodiment of the invention.
Figure 5:
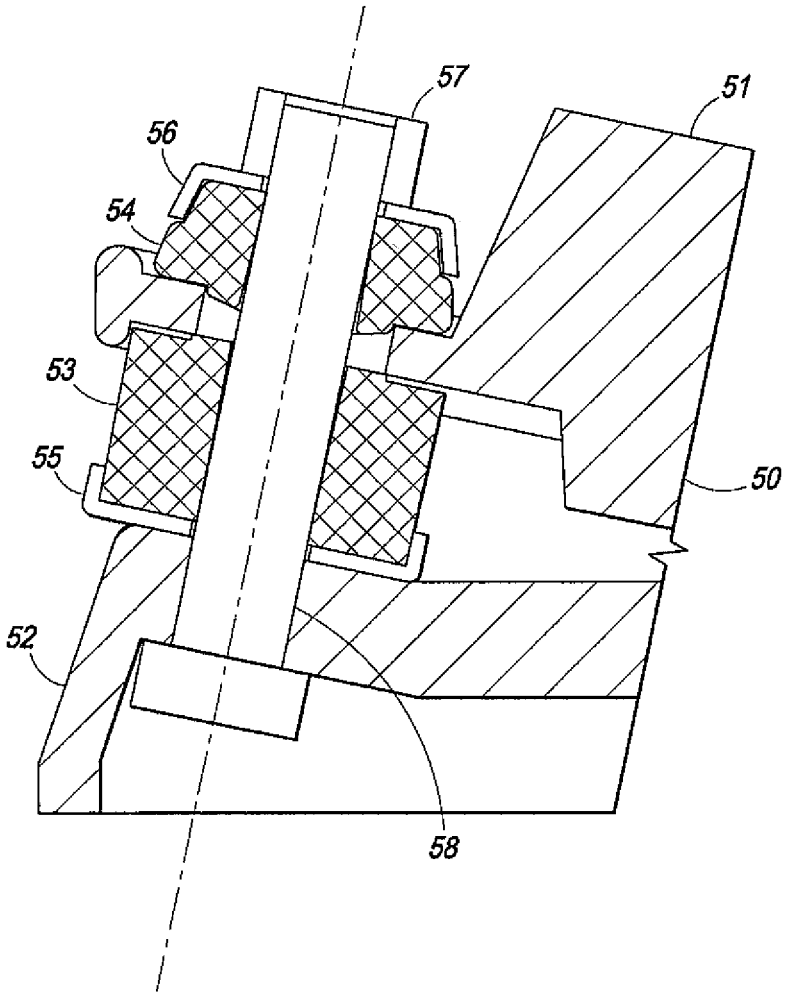
FIG. 5 Prior Art
FIG. 5 is a cross-sectional view of a conventional truck.

FIGS. 4A and 4B are directed to another embodiment of the invention. Second kingpin hole 31 is provided at the wheel axle end of axle housing 30 to hold a nut 42 of kingpin 43. The angle between the first end of axle housing 30 and pivot arm 34 is approximately 125°. Lining the circumference of second kingpin hole 31 is a flexible member 35 that allows flexibility of movement of the kingpin in axle housing 30. The flexible material is ridged and is for example, a metal wire mesh, a spring or a plurality of cables. In FIGS. 4A and 4B, the kingpin is of a conventional single piece nut and bolt configuration. Flexible member 35 is lightweight and allows the kingpin to sway within hole 31 to provide improved twisting and turning of the truck assembly. Flexible member 35 is further provided outside the kingpin hole directly under the portion that a nut 42 contacts axle housing 30. Therefore, both kingpin 43 and nut 42 flexibly move within axle housing 30. Unlike other trucks, the use of flexible member 35 provides a flexible connection for additional movement of kingpin 43 relative to housing 30 and provides an increased freedom of mobility similar to that of FIGS. 1A-1D.

With reference to FIG. 4B, a nut 41 of kingpin 43 is adjustable such that the spring tension of spring 40 is easily adjustable by a user to provide a desired level of feedback. Spring 40 is provided to be as long as possible and, in this embodiment, it is in contact with axle housing 30 and baseplate 20. Spring 40 compresses due to front-to-back shocks and vibrations between the ground and the deck. Spring 40 is set to absorb the kinetic energy of shocks and vibrations and transfers that energy directly into the deck to provide snap to the user instead of energy absorption provided by conventional rubber grommets and elastomeric springs. However, shock absorbing springs 40 may also be used.

Conventional grommets act as a dampener that will wear down as impacts are absorbed such that they quickly lose effectiveness. However, springs do not lose material due to impacts such that they provide consistent performance over a longer lifespan. Due to the consistency of the spring, adjustments to spring tension may be performed over a greater period of time than with traditional grommets.

The spring based trucks with the swinging kingpin provides the user with maximum snap and increased turning performance. The swinging kingpin improves pivoting that increases the mobility of the truck. The conventional single-piece kingpin does not allow this additional pivot point. With the present invention, turning is easier and wheel bite is reduced. These embodiments also improve the durability and consistency of a user's experience and may be applied to all types of skating such as longboarding, street skating and bowl skating.

The embodiments of the present invention are not limited to skateboards and can be used in in-line skates or the like. Modification to the particular embodiments of the invention described herein may be made without departing from the spirit and scope of the invention. The described embodiments are illustrative and not restrictive, and the scope of the invention is indicated by the appended claims, rather than the foregoing description. All modifications that come within the meaning and range of equivalency of the claims are therefore intended to be embraced therein.

The invention claimed is:

1. A truck assembly, comprising:

a baseplate including a pivot arm hole provided at a first end of the baseplate, a first kingpin hole provided at a second end of the baseplate and a coil spring holder provided at the second end of the baseplate;

a wheel axle couplable to a wheel on each end of the wheel axle;

a pivot arm inserted into the pivot arm hole of the baseplate;

an axle housing having a first housing end, a second housing end and a second kingpin hole;

the first housing end including the wheel axle and the second kingpin hole, and the second housing end including the pivot arm;

a swingable kingpin including a first substantially cylindrical portion and a second substantially cylindrical portion, wherein the first portion swings relative to the second portion by smooth toothless contact between the first portion and the second portion such that the swinging pivots the pivot arm about an axis passing through the pivot arm hole and the first kingpin hole; and a coil spring member provided substantially parallel to the swingable kingpin and coupled to and in direct contact with the coil spring holder of the baseplate and the first housing end of the axle housing.

2. The truck assembly according to claim 1, wherein the swingable kingpin includes a swing bolt and the first portion is a baseplate end and the second portion is an axle end, wherein the baseplate end is coupled to the first kingpin hole of the baseplate, the axle end is coupled to the second kingpin hole of the axle housing, and the swing bolt is coupled to the baseplate end and the axle end.

3. The truck assembly according to claim 2, wherein the baseplate end is concave and the axle end is convex.

4. The truck assembly according to claim 2, wherein the swing bolt is perpendicular to the wheel axle.

5. The truck assembly according to claim 2, wherein the baseplate end is at least the height of the axle end.

6. The truck assembly according to claim 2, wherein the axle end of the swingable kingpin locks into the second kingpin hole of the axle housing only through a first side of the axle housing so as to not protrude through the entire axle housing.

7. The truck assembly according to claim 2, wherein a tension of the kingpin is adjusted by adjusting a nut corresponding to the swing bolt.

8. The truck assembly according to claim 1, wherein the kingpin swings along a predetermined range to prevent wheel bite.

9. The truck assembly according to claim 1, wherein the coil spring member limits the swing of the swingable kingpin.

10. The truck assembly according to claim 1, wherein the kingpin is provided within an interior space of the coil spring member.

11. A skateboard, comprising:

a deck;

a truck assembly comprising:

a baseplate including a pivot arm hole provided at a first end of the baseplate, a first kingpin hole provided at a second end of the baseplate and a coil spring holder provided at the second end of the baseplate;

a wheel axle couplable to a wheel on each end of the wheel axle;

a pivot arm inserted into the pivot arm hole of the baseplate;

an axle housing having a first housing end, a second housing end and a second kingpin hole;

the first housing end including the wheel axle and the second kingpin hole, and the second housing end including the pivot arm;

a swingable kingpin including a first substantially cylindrical portion and a second substantially cylindrical portion, wherein the first portion swings relative to the second portion by smooth toothless contact between the first portion and the second portion such that the swinging pivots the pivot arm about an axis passing through the pivot arm hole and the first kingpin hole; and a coil spring member provided substantially parallel to the swingable kingpin and coupled to and in direct contact with the coil spring holder of the baseplate and the first housing end of the axle housing.

12. The skateboard according to claim 11, wherein the swingable kingpin includes a swing bolt and the first portion is a baseplate end and the second portion is an axle end, wherein the baseplate end is coupled to the first kingpin hole of the baseplate, the axle end is coupled to the second kingpin hole of the axle housing, and the swing bolt is coupled to the baseplate end and the axle end.

13. The skateboard according to claim 12, wherein the baseplate end is concave and the axle end is convex.

14. The skateboard according to claim 12, wherein the swing bolt is perpendicular to the wheel axle.

15. The skateboard according to claim 12, wherein the baseplate end is at least the height of the axle end.

16. The skateboard according to claim 11, wherein the kingpin swings along a predetermined range to prevent wheel bite.

17. The skateboard according to claim 11, wherein the kingpin is provided within an interior space of the coil spring member.

18. A truck assembly, comprising:

a baseplate including a pivot arm hole, a first kingpin hole and a coil spring holder;

a wheel axle couplable to a wheel on each end of the wheel axle;

a pivot arm inserted into the pivot arm hole of the baseplate;

an axle housing having a first end, a second end and a second kingpin hole;

the first end including the wheel axle and the second kingpin hole, and the second end including the pivot arm;

a kingpin coupled to the first kingpin hole of the baseplate and to the second kingpin hole of the axle housing;

a flexible member lined along the interior circumference and entire height of the second kingpin hole so as to cover the second kingpin hole from direct contact with the kingpin throughout the second kingpin hole;

a coil spring member provided substantially parallel to the kingpin and coupled to the coil spring holder and in direct contact with the baseplate and the first end of the axle housing; and a nut provided at the axle housing to adjust a tension of the spring member, wherein the nut is in direct contact only with the flexible member such that the flexible member alone covers the second kingpin hole from direct contact with the nut at the first end of the axle housing.

19. The truck assembly according to claim 18, wherein the flexible member is selected from the group consisting of a wire mesh, another spring member, and a plurality of cables.

20. The truck assembly according to claim 18, wherein the kingpin and the nut moves freely within a predetermined range within the second kingpin hole.

* * * * *